US005131021A

United States Patent [19]

Gard et al.

[11] Patent Number: 5,131,021

[45] Date of Patent: Jul. 14, 1992

[54] COMPUTED TOMOGRAPHY SYSTEM WITH CONTROL AND CORRECTION OF FAN BEAM POSITION

[75] Inventors: Michael F. Gard, New Berlin; August O. Englert, Waukesha, both of Wis.

[73] Assignee: General Electric Company, Milwaukee, Wis.

[21] Appl. No.: 718,521

[22] Filed: Jun. 21, 1991

[51] Int. Cl.[5] ..... G21K 1/12; G21K 1/02

[52] U.S. Cl. ..... 378/19; 378/146; 378/147; 378/901

[58] Field of Search ..... 378/19, 146, 901, 207, 378/4, 151.14, 145, 156.87, 51

[56] References Cited

U.S. PATENT DOCUMENTS 4,559,639 12/1985 Glover et al. ..... 378/19
4,750,196 6/1988 Harding ..... 378/87
4,831,260 5/1989 DiBianca ..... 378/151
4,856,041 8/1989 Klein et al. ..... 378/147
4,991,189 2/1991 Boomgaarden et al. ..... 378/4
5,050,199 9/1991 Watanabe ..... 378/146

*Primary Examiner*—Janice A. Howell
*Assistant Examiner*—Kim-Kwok Chu
*Attorney, Agent, or Firm*—Quarles & Brady

[57] ABSTRACT

A detector for detecting z-axis position in the plane of the fan beam of a computed tomography machine with respect to the detector array employs a pair of slotted masks over independent detector cells, the slots creating exposed widths that decrease and increase along their length. The intensity signals from the two detector cells so masked are subtracted to produce a z-axis position signal eliminating the effect of dark currents. Multiple cells may be ganged to reduce the effects of sensitivity variations among pairs of detector cells. The z-axis position signal may be used to control the z-axis position of the fan beam with respect to the detector array and to reduce the effect of the detector cell's variations in sensitivity.

10 Claims, 6 Drawing Sheets

FIG. 2
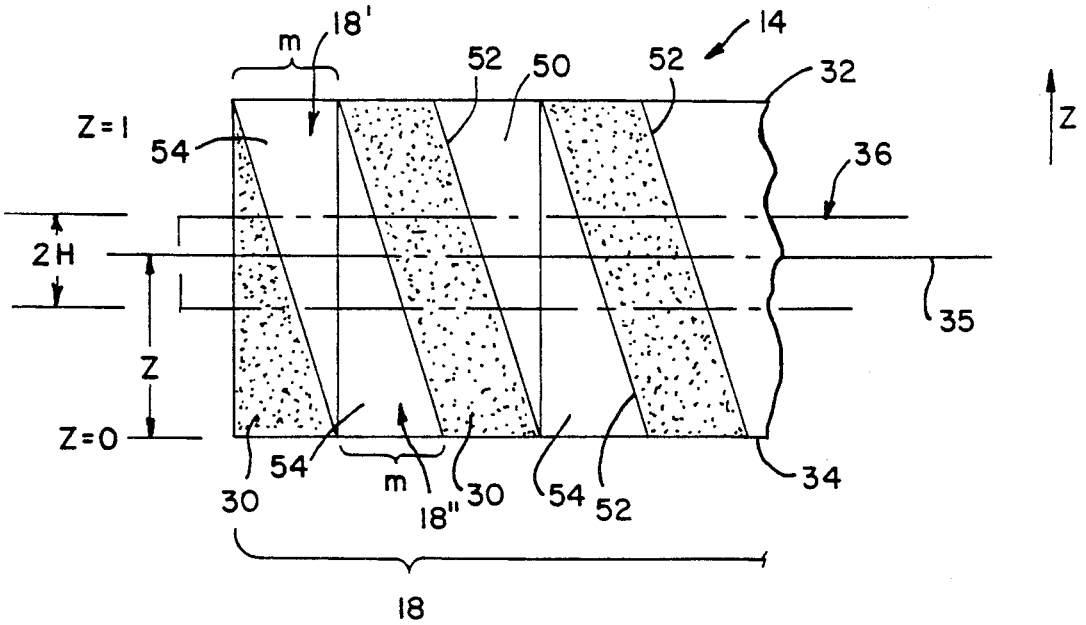
PRIOR ART
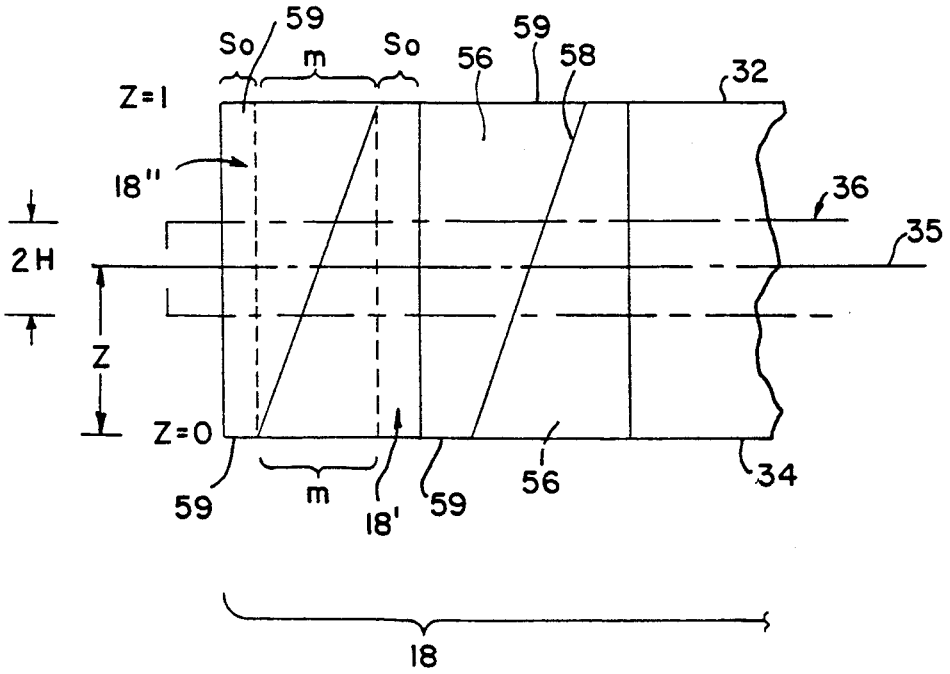
FIG. 5

48
50
42
44
39
41
40
26
19
21
22
4a
4a
46
X
Y
Z
38
45
43
Z

FIG. 8
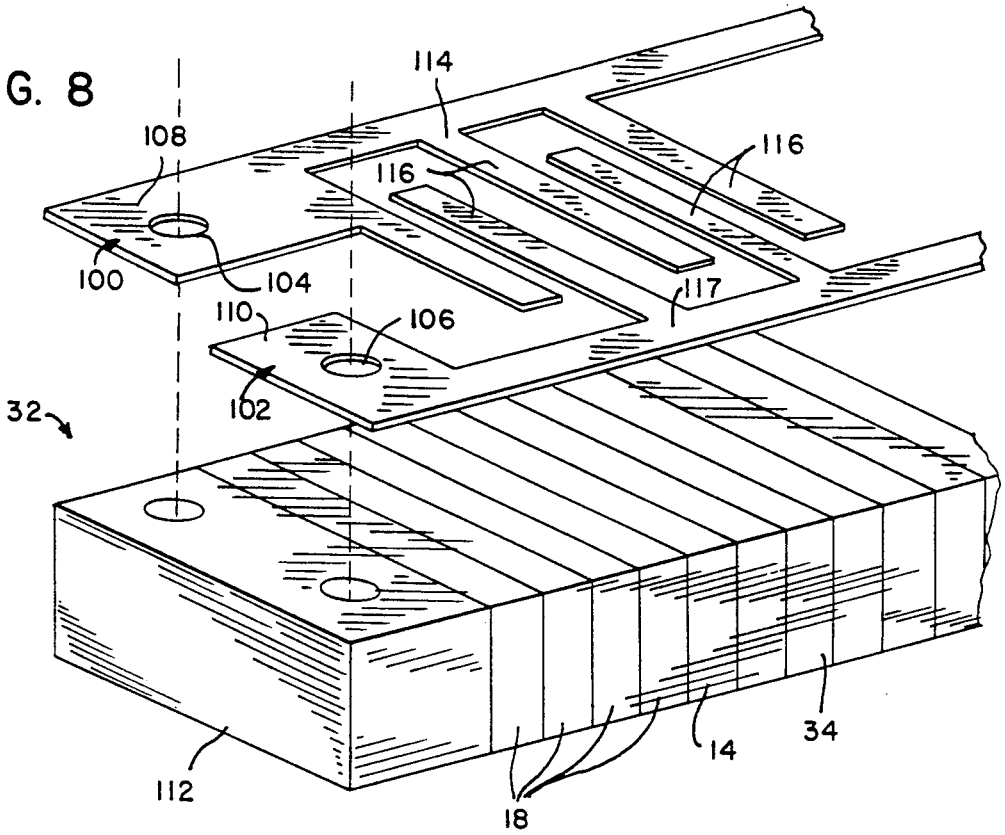
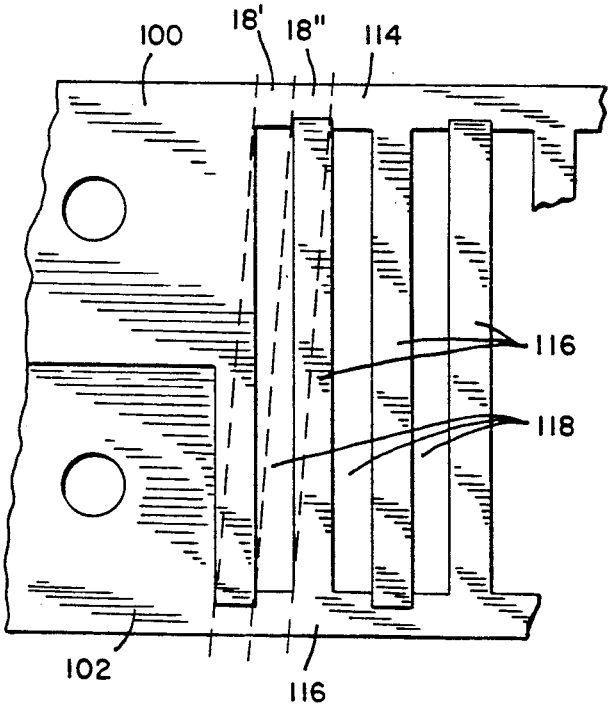
FIG. 9

COMPUTED TOMOGRAPHY SYSTEM WITH CONTROL AND CORRECTION OF FAN BEAM POSITION

BACKGROUND OF THE INVENTION

This invention relates to computed tomography equipment and the like and specifically to an x-ray detector for computed tomography and for determining the z-axis position of a fan beam of x-rays employed in such systems.

Computed tomography (CT) systems, as are known in the art, typically include an x-ray source collimated to form a fan beam, the fan beam extending generally along a fan beam plane and directed through an object to be imaged. After passing through the imaged object, the fan beam is received by an x-ray detector array extending along the fan beam plane. The x-ray source and detector array are rotated together on a gantry within an imaging plane, generally parallel to the fan beam plane, around the image object.

The axis of rotation of the gantry will be designated as the z-axis of the Cartesian coordinate system and the fan beam plane and imaging plane will be generally parallel to the x-y plane of the coordinate system.

The detector array is comprised of detector cells each of which measures the intensity of transmitted radiation along a ray from the x-ray source to that particular detector cell. At each gantry angle, a projection is acquired comprised of intensity signals from each of the detector cells. The gantry is then rotated to a new gantry angle and the process is repeated to collect a number of projections along a number of gantry angles to form a tomographic projection set.

Each tomographic projection set is stored in numerical form for later computer processing to "reconstruct" a cross sectional image according to algorithms known in the art. The reconstructed image may be displayed on a conventional CRT or may be converted to a film record by means of a computer driven camera.

Ideally, the fan beam plane will strike the center line of the detector array. In practice, however, the fan beam plane may be displaced from the center line because of two effects. The first effect is the thermal expansion of the x-ray tube's anode and its support. The surface temperature of the tube's anode may rise as high as 2000° C. and the anode supporting structure may rise to 400° C. or more. This heating and the resulting expansion of tube's anode and its support causes a shift the focal spot of the tube which moves the point from which the x-rays emanate. The shifting of the focal spot causes a corresponding shift in the fan beam plane.

The second effect is the mechanical deflection of the gantry and anode support as the gantry rotates. This deforming stress results from the changing angle of gravitational acceleration and the changing magnitude of centripetal acceleration as a function of the rotational velocity of the gantry, acting both on the gantry and anode.

Displacement of the fan beam plane from the center line of the detector array is a problem because it causes variations in detector signal that are "exogenous" or unrelated to the internal structure of the imaged object. Generally each detector cell's sensitivity to x-rays will be a function of the z-axis position of the fan beam along the surface of that cell, that is, the detector cells exhibit a "z-axis sensitivity". This z-axis sensitivity, combined with motion of the fan beam plane on the detectors, produces the undesired variations in the strength of the detector signal. Such exogenous variations in the detector signals produce undesirable ring like artifacts in the reconstructed image.

Compounding the problem of correcting for z-axis sensitivity is the fact that the z-axis sensitivity generally differs among different detector cells in the detector array. This difference will be termed "intercell sensitivity variation".

Displacement of the fan beam plane and thus variations in the detector signals may be predicted and corrected. In U.S. Pat. No. 4,991,189, issued Feb. 5, 1991, assigned to the same assignee as the present invention, and incorporated by reference, a control system using a movable collimator adjusts the z-axis position of the fan beam plane as deduced from a pair of special detector cells. The special detector cells provide information to a computer model of the system which in turn is used to control the collimator and to correct the placement of the fan beam plane.

U.S. Pat. No. 4,559,639, issued Dec. 17, 1985 and assigned to the same assignee as the present invention, and also incorporated by reference, describes such special detector cells suitable for use in the above described z-axis correction. In one embodiment, shown in FIG. 4A of that patent, a single detector cell is covered with a wedge shaped opaque mask. Z-axis movement of the fan beam along this detector generates a z-signal whose intensity is dependent on that displacement. This z-signal is divided by the signal from an uncovered cell to normalize the z-signal's value to a range between one and zero. Thus, the relative displacement of the fan beam over the surface of the detectors may be determined. The normalized signal indicates that the fan beam is centered on the mask when it is equal to $\frac{1}{2}$.

There are a number of drawbacks to the above method of detecting the z-axis position of the fan beam plane. The first is that the normalization process of dividing the z-signal by the signal from an uncovered cell requires an arithmetic division operation which is problematic in the context of a real time feedback system. A second drawback is that both detector cells, that producing the z-signal and the uncovered cell, may exhibit significant offsets in their intensity signals, that is, a finite intensity signal may be present even in the absence of any radiation. Such offsets are termed "dark currents" and operate to shift the relative center indicated by the z-signal from the actual center of the detector. For example, with dark currents, a normalized z-signal of $\frac{1}{2}$ will not correspond to the center of the detector.

Yet a further problem with the disclosed method of producing a z-signal is that of intercell sensitivity variation, i.e., the z-axis sensitivity of each detector cell is generally different from that of its neighbors. Hence the use of a reference cell to normalize the Z signal is only partially successful.

Finally, a center value of $\frac{1}{2}$ is inconvenient for closed loop control where a center value of zero is to be preferred.

In a second embodiment shown in the above referenced patent, the shape of the radiation receiving face of a detector cell is altered from a rectangular outline to a trapezoidal outline by slanting the dividing wall between a pair of adjacent detector cells. In this configuration, the intensity signals from the two detector cells are opposite functions of each other. The intensity signal from one detector cell increases with z-axis motion of the fan beam in one direction while the intensity signal from the other detector cell decreases. Subtracting these two signals successfully eliminates the effect of dark currents; however, the difference signal is still normalized, in this case by dividing it by the sum of the two signals. Thus, the problematic division operation is still required.

A second drawback to this embodiment is that physics and manufacturing requirements prevent sloping the dividing wall between adjacent detector cells so as to create a truly triangular radiation receiving face, but rather requires the creation of a trapezoidal receiving face. For an ionization-type detector, the dividing walls must remain electrically isolated necessitating a significant wall spacing. For solid state detectors, any deviation from the rectangular shape employed by the majority of the other detector elements is prohibitively expensive. As will be described below, it is believed that the trapezoidal receiving face adversely accentuates the effect of intercell sensitivity variation in the computation of z-axis displacement.

SUMMARY OF THE INVENTION

In the present invention, multiple x-ray opaque masks are used with two ordinary detector cells to provide two signals whose difference may be used to directly control the x-ray fan beam. The invention provides a z-signal that is less affected by dark currents and intercell sensitivity variations.

Specifically, a first and second detector cell are covered by masks which have openings over their radiation receiving faces. The mask of the first cell creates an opening whose width increases along its length from the front of the cell to the back of the cell. Conversely, the mask of the second cell creates an opening whose width decreases along its length from the front of the cell to the back of the cell. The signals from these two cells are subtracted to yield a robust measurement of the z-axis position of the fan beam on the surface of the detector array, such measurements being equal to zero at the centerline of the array without the need for normalization.

It is one object of the invention, therefore, to allow real time correction of the fan beam's position in response to environmental influences such as rotational stress and thermal expansion. The use of opposing masks allows a simple computational determination of centerline of the fan beam suitable for real time control. Unlike previous methods, no normalization or division is required to produce the centerline determination, and the required subtraction of detector signals is readily accomplished with conventional analog circuitry.

It is yet another object of the invention to provide a simple means for generating a robust z-axis position signal without radical changes in the structure of the detectors. The masks may be fit over conventional detector cells as are presently used with CT systems without radical modification of the cells.

It is yet a further object of the invention to provide a z-axis position signal that is less subject to the effects of intercell sensitivity variation. The masks allow the radiation receiving portions of the cells to be tailored to reduce the intercell sensitivity variation.

In a second embodiment, the effect of intercell sensitivity variations are further reduced by the use of a plurality of first and second detector cells, masked as before, whose outputs are summed to produce a first and second composite signals. Generally, the variations in z-axis sensitivity between the composite signals will be reduced as a result of an implicit averaging of the cell's signals.

Other objects and advantages besides those discussed above shall be apparent, to those experienced in the art, from the description of a preferred embodiment of the invention which follows. In the description, reference is made to the accompanying drawings, which form a part hereof, and which illustrate one example of the invention. Such example, however, is not exhaustive of the various alternative forms of the invention, and therefore reference is made to the claims which follow the description for determining the scope of the invention.

BRIEF DESCRIPTION OF THE DRAWINGS

FIG. 2 is a schematic view of the peripheral detector cells of the detector array of FIG. 1;

FIGS. 4(*a*) and (*b* ) are cross sectional views of the mandrel of the collimator of FIG. 3 showing orientation of the mandrel for thick and thin fan beams respectively;

FIG. 5 is a schematic view of prior art peripheral detector cells of the detector array of FIG. 1;

FIG. 8 is an exploded perspective view of the mask and detector cells of FIG. 2;

FIG. 9 is a plan view of the mask and detector cells of FIG. 2 as seen from the x-ray tube of FIG. 1.

DETAILED DESCRIPTION OF THE PREFERRED EMBODIMENT

Figure 1:
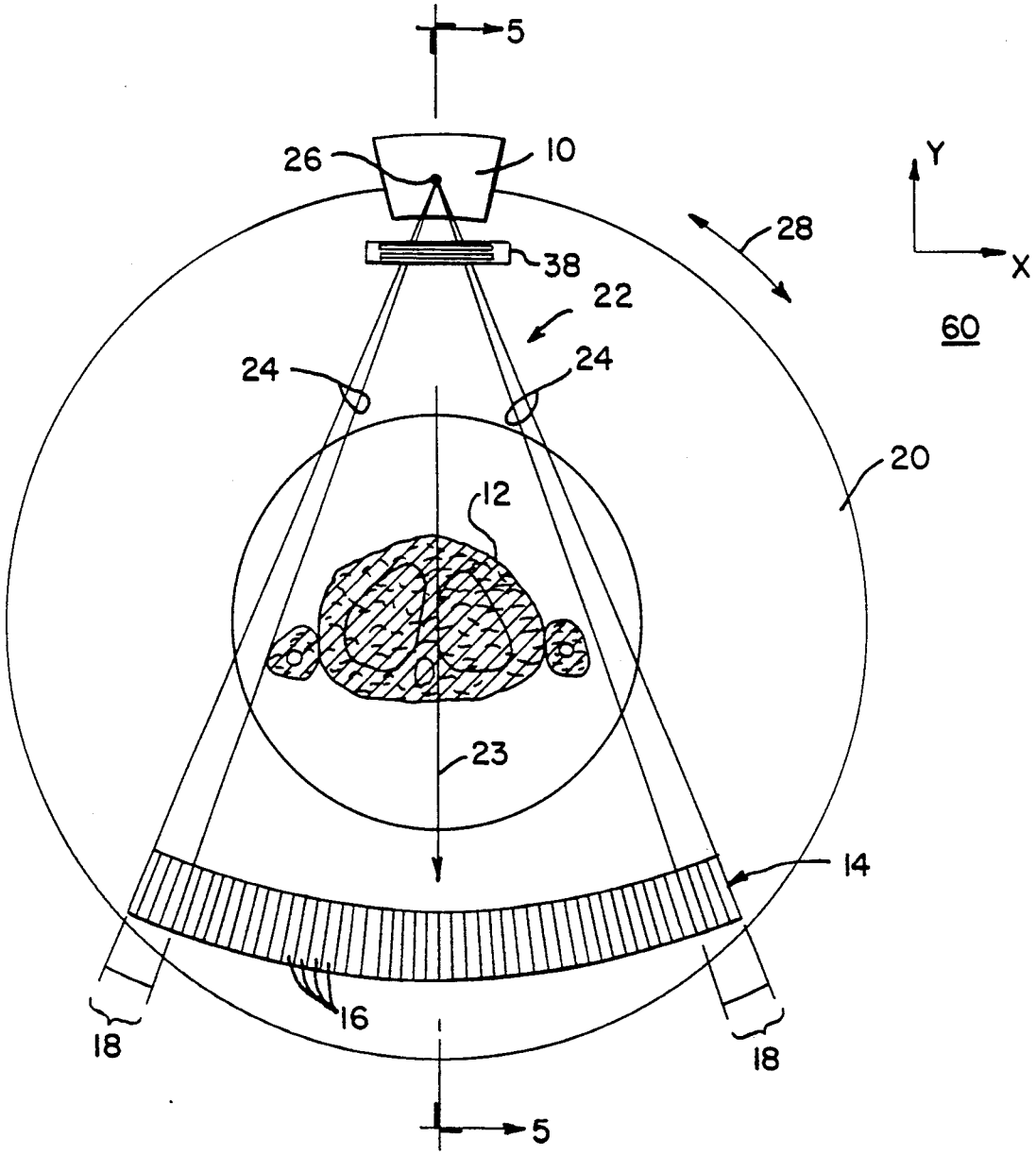
FIG. 1 is a schematic representation of an x-ray source and x-ray detector array as may be used with the present invention.

Referring to FIG. 1, a gantry 20, representative of a "third generation" computed tomography scanner, includes an x-ray source 10 collimated by collimator 38 to project a fan beam of x-rays 22 through imaged object 12 to detector array 14. The x-ray source 10 and detector array 14 rotate on the gantry 20 as indicated by arrow 28, within an imaging plane 60, aligned with the x-y plane of a Cartesian coordinate system, and about the z-axis of that coordinate system (not shown in FIG. 1).

The detector array 14 is comprised of a number of detector cells 16, organized within the imaging plane 60, which together detect the attenuated transmission of x-rays through the imaged object 12.

The fan beam 22 emanates from a focal spot 26 in the x-ray source 10 and is directed along a fan beam axis 23 centered within the fan beam 22. The fan beam angle, measured along the broad face of the fan beam, is larger than the angle subtended by the imaged object 12 so that two peripheral beams 24 of the fan beam 22 are transmitted past the body without substantial attenuation. These peripheral beams 24 are received by peripheral detector cells 18 within the detector array 14.

Figures 3, 4A, 4B:
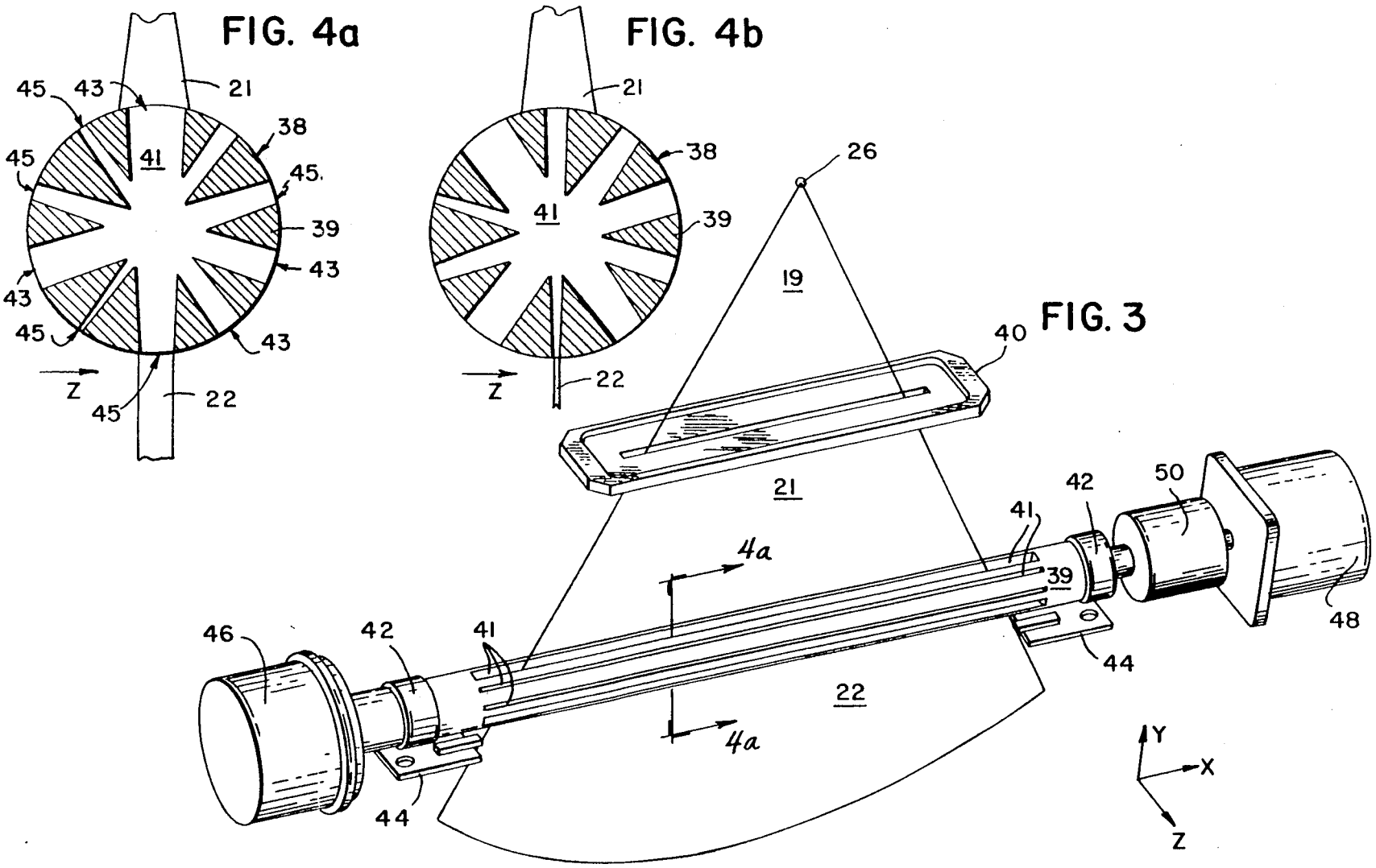
FIG. 3 is a perspective view of a collimator assembly suitable for use with the present invention.

Referring to FIG. 3, uncollimated x-rays 19 radiating from the focal spot 26 in the x-ray source 10 (not shown in FIG. 3) are formed into a coarse fan beam 21 by primary aperture 40. The coarse fan beam 21 is collimated into fan beam 22 by means of collimator 38.

Referring generally to FIGS. 3, 4(*a*) and 4(*b*), collimator 38 is comprised of a cylindrical x-ray absorbing molybdenum mandrel 39 held within the coarse fan beam 21 on bearings 42 allowing the mandrel 39 to rotate along its axis. A plurality of tapered slots 41 are cut through the mandrel's diameter and extend along the length of the mandrel 39. The slots 41 are cut at varying angles about the mandrel's axis to permit rotation of the mandrel 39 to bring one such slot 41 into alignment with the coarse fan beam 21 so as to permit the passage of some rays of the coarse fan beam 21 through the slot 41 to form fan beam 22.

Referring to FIGS. 4(*a*) and 4(*b*), the tapered slots 41 are of varying width and hence the rotation of the mandrel 39 allows the width of the fan beam 22 to be varied between a narrow (1 mm) beam width as shown in FIG. 4(*b*) and wide (10 mm) beam width as shown in FIG. 4(*b*). The slots 41 ensure dimensional accuracy and repeatability of the fan beam 22.

The slots 41 are tapered so that the entrance aperture 43 of each slot 41, when orientated with respect to the coarse fan beam 21, is wider than the exit aperture 45. The exit aperture 45 defines the width of the fan beam 22 and the extra width of the entrance aperture 43 prevents either edge of the entrance aperture 43 from blocking the coarse fan beam 21 during rotation of the mandrel 39 when such rotation is used to control the alignment of the fan beam axis 23 as will be discused in detail below.

Referring again to FIG. 3, a positioning motor 48 is connected to one end of the mandrel 39 by flexible coupling 50. The other end of the mandrel 39 is attached to a position encoder 46 which allows accurate positioning of the mandrel by motor 48. Fan beam angle shutters 44 at either ends of the mandrel 39 control the fan beam angle.

Referring to FIG. 2, the fan beam 22 (not shown in FIG. 2) exposes an area 36 on the detector array 14 and, accordingly, on the peripheral detector cells 18. The width of the exposed area 36 along the z-axis will be defined as 2H.

The centerline 35 of area 36, commensurate with the fan beam plane, may generally move with respect to the detector array 14 in the z axis direction as a result of thermal expansion of the x-ray tube or rotational stress, as have been described. The location of the centerline 35 may be described by a value Z taken as the measure from a rear edge 34 of the detector array 14 to the centerline 35 along the z axis. The rear edge 34 is the extreme edge of the detector array 14 in one direction along the z axis, and will be defined as $Z=0$, whereas the front edge 32 of the detector array is defined as the edge of the detector array 14 at its extreme in the other direction along the z axis, and will be taken as $Z=1$.

The entire face of each peripheral cell 18 is not exposed within area 36. First, area 36 itself covers only a portion of the z axis extent each peripheral cell 18, and second, an x-ray opaque mask 30 obscures a portion of each of the peripheral detector cells 18 preventing that portion from receiving the full intensity of the x-ray fan beam 22 even when within the exposed area 36. Specifically, mask 30 covers one-half of each peripheral cell 18, dividing the generally rectangular face of each cell 18, exposed to x-rays, along a diagonal line 52 between the corners of the cell 18 so that exactly one-half of the peripheral cell 18 may receive x-rays and one-half is blocked from receiving x-rays. It will be recognized that other mask shapes may be used provided they have openings that vary oppositely with z axis position.

The portion of each peripheral cell 18 that is masked from x-rays is alternated for every other cell 18. The portion of a peripheral cell 18 within exposure area 36 and exposed to x-rays, increases as Z increases, if it is an odd numbered cell, and decreases as Z increases if it is an even numbered cell. In the preferred embodiment, ten cells are masked: five even cells and five odd cells, however, other numbers of cells 18 may be used and the number of odd and even cells 18 need not be equal, provided appropriate weighting is given to the signals produced by the combined even and odd cells 18, so that the signals are substantially equal for a centered fan beam. Generally, the more cells which are used, the better the reduction in intercell sensitivity effects.

The mask 30 preferably creates a right triangle 54 of exposed area on each peripheral cell 18 and may be contrasted to the prior art shown in FIG. 5 in which the peripheral cells 18 are not masked but physically formed in wedge shapes. Specifically, in the prior art, each pair of adjacent peripheral cells 18 are divided by an oblique dividing wall 58. Physical constraints in the construction of these peripheral cells 18, prevent the dividing walls 58 from dividing the cells 18 into perfect right triangles but rather divide the cells into two equal trapezoids 56, each having parallel bases 59 of length $S_0$ and $M+S_0$.

Referring to FIGS. 2 and 3, the signals, $I_1$, and $I_2$, (not shown) produced by each pair of peripheral cells 18' and 18'' for the present invention may be contrasted to the signals, $I_3$, and $I_4$, (not shown) produced by each pair of peripheral cells 18'' and 18''' for the prior art. For the prior art detector the intensity signals $I_3$ and $I_4$ for a first and second adjacent peripheral cell 18 are:

$$I_3 = \alpha_3(Z)\int_{Z-H}^{Z+H}(S_0 + mZ)dz = \alpha_3(Z)(S_0 2H + m2HZ) \quad (1)$$

$$I_4 = \alpha_4(Z)\int_{Z-H}^{Z+H}[S_0 + m(1 - Z)]dz = \alpha_4(Z)[(S_0 + m)2H - 2mHZ] \quad (2)$$

where $\alpha_3(Z)$ and $\alpha_4(Z)$ are the sensitivities of the detector cells 18' and 18'' as a function of Z, 2H is the thickness of the fan beam 22 as previously defined, $S_0$ is the length of the smaller base 59, and m is the slope of the dividing wall 58.

The difference between these signals near the important value of $Z=\frac{1}{2}$, the center of the detector array 14, is:

$$I_3 - I_4 = S_0 2H\Delta + mH\Delta \quad (3)$$

where $\Delta=\alpha_3(Z)-\alpha 4(Z)$, the difference between the sensitivities of the two cells as a result of intercell sensitivity variation.

In contrast, for the present invention, shown in FIG. 2, the intensity signals $I_1$ and $I_2$ for a first and second complimentary peripheral cell 18' and 18'' are $$I_1 = \alpha_1(Z)\int_{Z-H}^{Z+H} mZdz = \alpha_1(Z)(m2HZ) \quad (4)$$

$$I_2 = \alpha_2(Z)\int_{Z-H}^{Z+H} [m(1-Z)]dz = \alpha_2(Z)[(m2H - 2mHZ] \quad (5)$$

where again $\alpha_1(Z)$ and $\alpha_2(Z)$ are the sensitivities of the detector cells 18' and 18'' as a function of Z, 2H is the thickness of the fan beam 22, and m is the slope of the diagonal 52 as a function of Z or more generally the rate of change of the width of the mask with Z.

Here the difference between these signals $I_1$ and $I_2$ at $Z=\frac{1}{2}$, the center of the detector array 14, is simply:

$$I_1 - I_2 = mH\Delta \quad (6)$$

where $\Delta = \alpha_1(Z) - \alpha_2(Z)$

Reviewing equation (3) and (6), it can be seen that the use of a mask 30 as opposed to the trapezoidal wall 58 allows the difference between the intensity signals of equations (3) and (5), that is the z-axis position signal, to be less susceptible to intercell sensitivity variation by an amount of $S_0 2H\Delta$. If m is limited to approximately twice $S_0$, as a result of physical constraints of the detector array 14 geometry, then the present invention reduces the intercell sensitivity by a factor of two.

Figure 6:
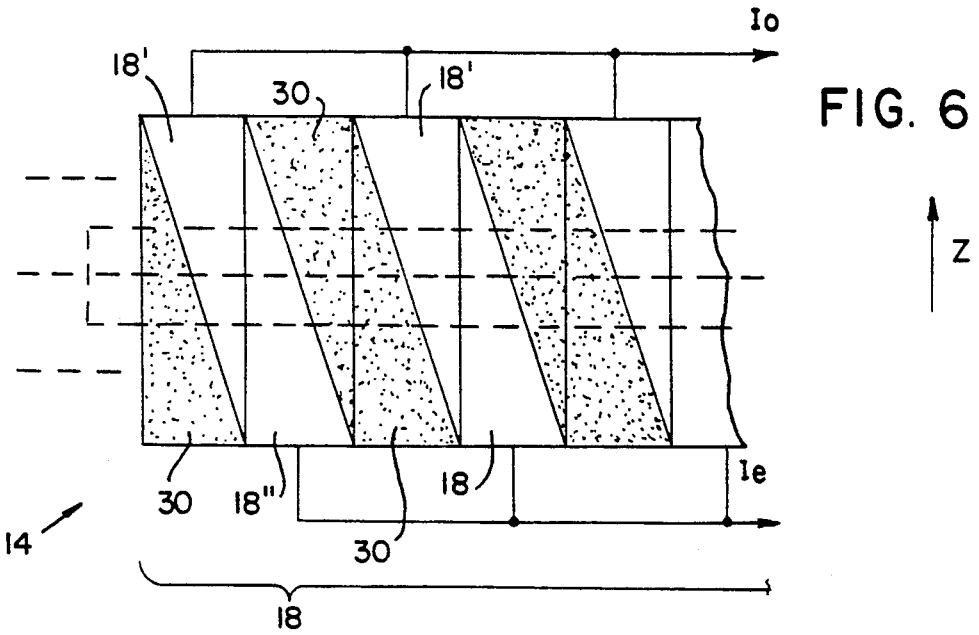
FIG. 6 is a schematic view, similar to that of FIG. 2, showing the connection of multiple peripheral detector cells to create a composite signal.

Referring now to FIG. 6, the intensity signals from the odd numbered cells are collected together to form a composite signal $I_o$ and the intensity signals from the even cells are connected together to form a composite signal $I_e$.

Figure 7:
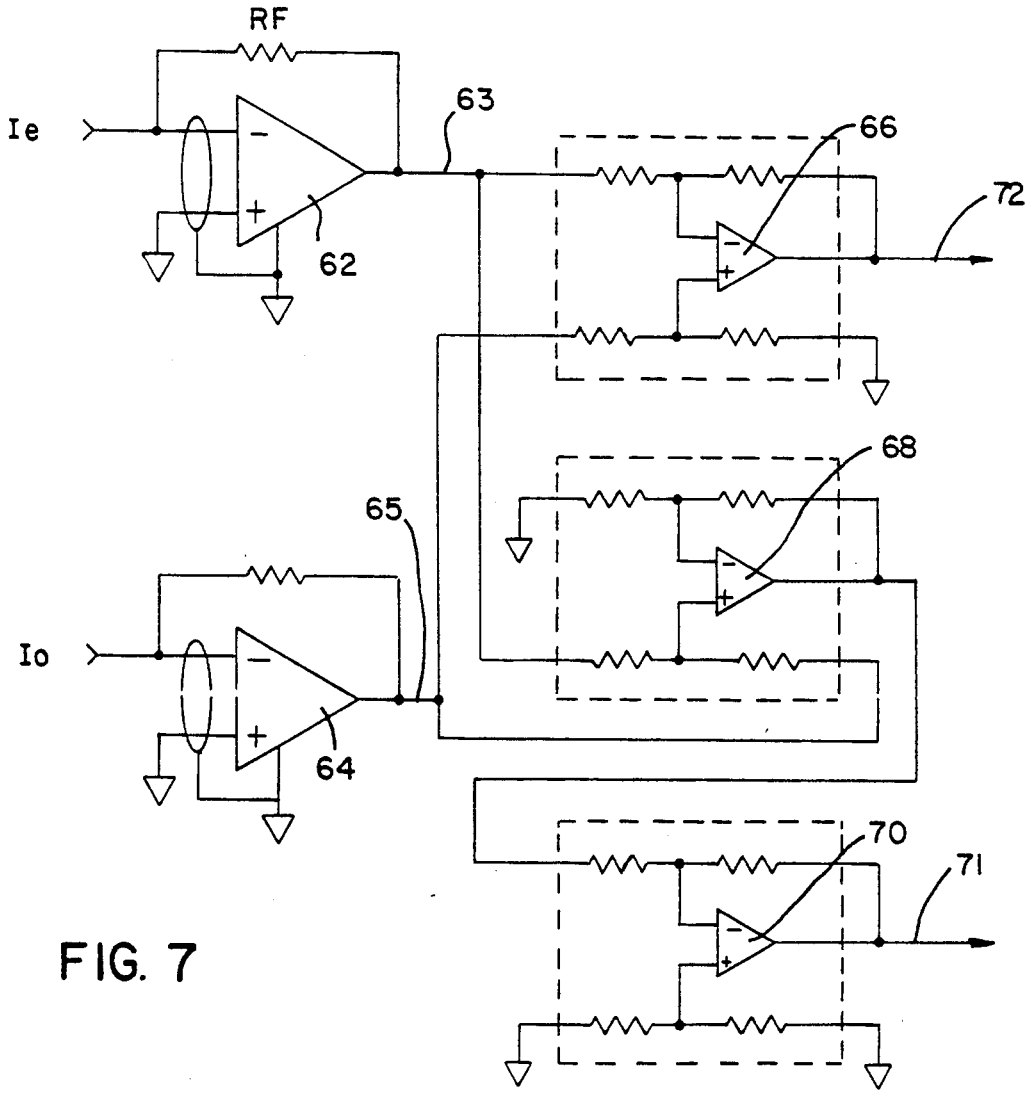
FIG. 7 is a schematic diagram of a summing circuit suitable for producing a z-axis position signal from the composite signals of the detector cells of FIG. 6.

In FIG. 7, amplifiers 66, 68, and 70 employ internal resistive elements as may be obtained with AMPO3FJ amplifiers manufactured by Precision Monolithics Incorporated, Santa Clara, Calif. - which are precision unity-gain differential amplifiers incorporating ratio-matched, thin-film resistor networks on the amplifier die. Those skilled in the art will recognize that this arrangement has a number of desirable advantages, notably excellent thermal tracking of the resistors, improved common-mode signal rejection, and reduced part count.

As a consequence of this choice, amplifier 68 is used as a non-inverting summing amplifier. Because of the internal topology, amplifier 68 cannot be used in a conventional two-input inverting amplifier configuration. For complete generality in experimental applications, amplifier 70 was included as a unity-gain inverter.

It is noted that a conventional inverting summing amplifier would be substituted for amplifiers 68 and 70 shown in FIG. 7.

Referring still to FIG. 7, the composite signals $I_o$ and $I_e$ are received by operational amplifiers 62 and 64 configured in a transimpedance configuration, as is well understood, to provide preamplification to the composite detector signals $I_o$ and $I_e$ to produce buffered signals 63 and 65. These buffered signals 63 and 65 are then subtracted by operational amplifier 66 to produce a z-axis position indicating signal 72. These buffered signals 63 and 65 are also summed together by operational amplifier 68 as is well understood in the art, followed by polarity inversion (gain of −1) provided by operational amplifier 70. The summed signal 71 may be used to produce a normalized indication of Z for certain other applications.

Referring to FIGS. 8 and 9, the mask 30 used for the peripheral detector cells 18 is constructed from a pair of tungsten combs 100 and 102 fastened over the exposed faces of the peripheral cells 18 of the detector array 14 by machine screws (not shown), the screws received by holes 104 and 106 in mounting tabs 108 and 110, forming one end of each comb 100 and 102. The machine screws pass through the holes 104 and 106 and are received by an end portion 112 of the detector array 14 removed from the peripheral cells 18. A spine 114, of comb 100, connects to the tab 108 and extends along the front edge 32 of the detector array 14 when the comb 100 is in place on the detector array 14, as held by tab 108. Conversely, a spine 117, of the comb 102, is attached to tab 110 and proceeds along the rear edge 34 of the detector array 14 when comb 102 is in place on the detector array held by tab 110.

Each comb 100 and 102 has a set of generally rectangular teeth 116 each approximately equal in width to the width of each peripheral cell 18 measured perpendicularly to the z-axis. Each tooth 116 extends array 14 from each spine 114 or 117 over the face of the peripheral cells 18 to the opposing edge of the detector array 14. The teeth 116 are spaced apart from each other so that when the two combs 100 and 102 are in place on the detector array 14, their teeth 116 are interleaved and equally spaced from the teeth 116 of the opposing comb 100 or 102 so as to create oblique slots 118, also generally equal in width to the width of each detector cell 18. The tips of the teeth 116 furthest from their respective spine 114 or 117 extend sufficiently so as to rest on the spine 117 or 114 of the opposed comb 100 or 102 thereby providing the teeth 117 with support and preventing a seam that might admit x-ray radiation.

Referring to FIG. 9, each tooth 116 may form the mask 30 for up to two adjacent cells 18' and 18''.

Figure 10:
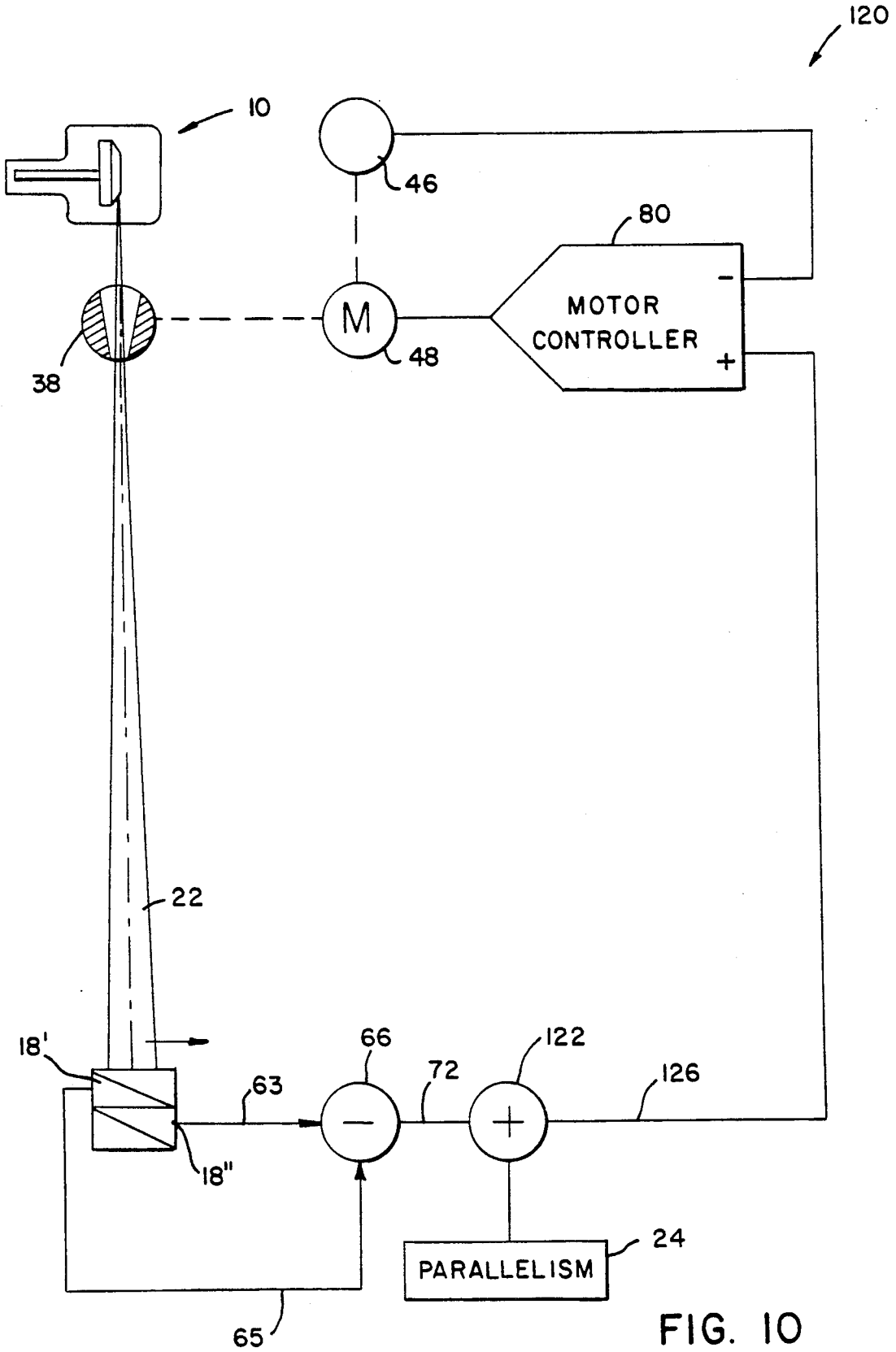
FIG. 10 is a block diagram of a feedback control system employing the z-axis position signal produced by the circuit of FIG. 7.

Referring to FIG. 10, a feedback control system 120 controls the position of the collimator 38 in response to changes, for example, in the position of the focal spot 26.

The signals 63 and 65 from the even and odd peripheral cells 18' and 18'' are subtracted, as previously described, by amplifier 66 to create a z-axis position signal 72. A constant parallelism value 124 may be added to the z-axis position signal 72 at summing node 122 to provide a control signal 126 which allows the fan beam centerline 35 to be held away from the exact center of the detector array 14 to allow the fan beam plane to be made parallel with the imaging plane as previously described.

The control signal 126 is connected to a motor controller 80 to position the collimator 38 so as to cause the value of the control signal 126 to move to zero.

Motor controller 80 is a feedback controller as is generally understood in the art and employs the position encoder 46 to control the fan beam centerline 35 by means of motor 48. Motor controller 80 also includes a means for offsetting the collimator 38 to the various angular offsets required to bring various of the slots 41 into alignment with the coarse fan beam 21 and thus to control the fan beam width.

The above description has been that of a preferred embodiment of the present invention. It will occur to those who practice the art that many modifications may be made without departing from the spirit and scope of the invention. For example, the fan beam may be aligned to a position that is a compromise between reducing z-axis misalignment and improving the parallelism between the fan beam plane and the image plane. In order to apprise the public of the various embodiments that may fall within the scope of the invention, the following claims are made.

I claim:

1. A z-axis fan beam position detector for a computed tomography system having an x-ray source for producing a fan beam of x-rays along a fan beam plane, comprising:

a first peripheral and second peripheral detector cell having a first and second face for receiving a portion of the fan beam of x-rays, the faces extending perpendicularly across the fan beam plane along a length between a front and a back edge of each detector cell, the first and second detector cell producing a first and second intensity signal, respectively, indicating the total x-ray energy received at the first and second face;

a first detector cell mask positioned over the first face and having an opening with a length extending between the front and back edge, the width of the opening, over the first face, increasing along its length from front to back;

a second detector cell mask positioned over the second face and having an opening extending between the front and back edge, the width of the opening, over the second face, increasing along its length from the back to front; and a computation means for taking the difference between the first intensity signal and the second intensity signal to produce a z-axis position signal.

2. The z-axis position detector recited in claim 1 where the width of each opening changes linearly as a function of its length from zero to a predetermined value.

3. The z-axis position detector recited in claim 1 where the width of the opening of the first mask halfway along its length is equal to the width of the opening of the second mask halfway along its length.

4. The z-axis position detector recited in claim 1 where the openings are asymmetric about an axis bisecting the detectors from the front to the back.

5. A z-axis fan beam position detector for a computed tomography system having an x-ray source for producing a fan beam of x-rays along a fan beam plane, comprising:

a plurality of first peripheral detector cells having first faces for receiving a portion of the fan beam of x-rays, the faces extending perpendicularly across the fan beam plane along a length between a front and a back edge of each detector cell, and for producing a plurality of first intensity signals indicating the total x-ray energy received by each first face;

a plurality of second peripheral detector cells having second faces for receiving a portion of the fan beam of x-rays, the faces extending perpendicularly across the fan beam plane along a length between a front and a back edge of each detector cell, and for producing a plurality of second intensity signal indicating the total x-ray energy received by each second face;

a plurality of first detector cell masks having openings with a length extending between the front and back edge, the width of the openings over each face increasing along its length from front to back;

a plurality of second detector cell masks having openings with a length extending between the front and back edge, the width of the openings over each face increasing along its length from the back to the front;

a summing means for summing the first intensity signals from the first detector cells to produce a first composite intensity signal and for summing the second intensity signals from the second detector cells to produce a second composite intensity signal; and a computation means for taking the difference between the first composite intensity signal and the second composite intensity signal to produce a z-axis position signal.

6. The z-axis position detector recited in claim 5 wherein the width of each opening changes linearly as a function of its length from zero to a predetermined value.

7. The z-axis position detector recited in claim 5 wherein the width of the opening of each of the first detector cells, halfway along its length, is equal to the width of the opening of each of the second detector cells halfway along its length.

8. The z-axis position detector recited in claim 5 where the apertures of the detector cells are asymmetric about an axis bisecting the detector cells along each detector cell's length.

9. The z-axis position detector as recited in claim 5 wherein the first and second masks are together comprised of a first and second interlocking comb of x-ray opaque material, the first comb having a first spine for holding a plurality of teeth projecting obliquely across the faces of the detector cells when the spine is in position extending along the front edge of the detector cells; and the second comb having a second spine for holding a plurality of teeth projecting obliquely across the faces of the detector cells when the spine is in position extending along the back edge of the detector cells, the teeth of the first comb positionable to interleave with the teeth of the second comb to create the openings therebetween.

10. In a computed tomography system having an x-ray source for producing a fan beam of x-rays along a fan beam plane directed toward a detector cells, a control system for controlling the position of the fan beam with respect to the detector cells comprising:

a first peripheral and second peripheral detector cell having a first and second face for receiving a portion of the fan beam of x-rays, the faces extending perpendicularly across the fan beam plane along a length between a front and a back edge of each detector cell, the first and second detector cell producing a first and second intensity signal, respectively, indicating the total x-ray energy received at the first and second face;

a first detector cell mask positioned over the first face and having an opening with a length extending between the front and back edge, the width of the opening, over the first face, increasing along its length from front to back;

a second detector cell mask positioned over the second face and having an opening extending between the front and back edge, the width of the opening, over the second face, increasing along its length from the back to front;

a computation means for taking the difference between the first intensity signal and the second intensity signal to produce a z-axis position signal having a value; and a fan beam angulation means for controlling the angle of the fan beam in response to the value of the z-axis position signal.

* * * * *